US006152576A

United States Patent [19]

Mount

[11] Patent Number: 6,152,576

[45] Date of Patent: Nov. 28, 2000

[54] METHOD FOR SUPPORTING A DECORATIVE LIGHT ARRAY

[76] Inventor: Todd J. Mount, 1918 Nancy Jane Cir., Garland, Tex. 75043

[21] Appl. No.: 09/236,730

[22] Filed: Jan. 25, 1999

[51] Int. Cl.[7] ..... F21S 4/00; F21V 21/00

[52] U.S. Cl. ..... 362/252; 362/391; 362/806

[58] Field of Search ..... 362/123, 227, 362/249, 250, 252, 391, 806, 807

[56] References Cited

U.S. PATENT DOCUMENTS

| | | | |
|---|---|---|---|
| D. 400,272 | 10/1998 | Mount | D26/25 |
| 1,640,282 | 8/1927 | Migliaccio | 362/252 |
| 3,096,943 | 7/1963 | Forrer | 362/123 |
| 4,264,845 | 4/1981 | Bednarz | 315/323 |
| 4,720,773 | 1/1988 | Ahroni | 362/249 |
| 4,736,282 | 4/1988 | Ahroni | 362/123 |
| 4,870,547 | 9/1989 | Crucefix | 362/123 |
| 5,057,976 | 10/1991 | Dumong | 362/123 |
| 5,213,519 | 5/1993 | Dorfman | 439/505 |
| 5,338,585 | 8/1994 | Fraus et al. | 428/18 |
| 5,379,202 | 1/1995 | Daun | 362/252 |
| 5,424,925 | 6/1995 | Jenke et al. | 362/123 |
| 5,601,361 | 2/1997 | Lawrence | 362/249 |
| 5,632,550 | 5/1997 | Yeh | 362/123 |
| 5,645,342 | 7/1997 | Chang | 362/252 |
| 5,662,409 | 9/1997 | Huang | 362/249 |
| 5,860,731 | 1/1999 | Martinez | 362/252 |
| 5,934,793 | 8/1999 | Rahman | 362/249 |
| 5,944,408 | 8/1999 | Tong et al. | 362/252 |

*Primary Examiner*—Alan Cariaso
*Attorney, Agent, or Firm*—Larson & Larson, PA; James E. Larson

[57] ABSTRACT

The method provides a decorative array of spaced apart multiple light bulbs mounted on spaced apart rows of two intertwined insulated electrical conductors electrically connected to each light bulb. Wire or tubing is strung between the intertwined insulated electrical conductors at a connection to a light bulb in a designated pattern. A top row of two intertwined insulated electrical conductors is attached to a structure and other rows of intertwined insulated electrical conductors depend from the top row.

15 Claims, 7 Drawing Sheets

METHOD FOR SUPPORTING A DECORATIVE LIGHT ARRAY

This invention relates to decorative electric light arrays. More particularly, it refers to a method of protecting a decorative light array from wind entanglement and damage.

BACKGROUND OF THE INVENTION

Decorative light arrays have become popular additions to homes and businesses, particularly during the month of December. To satisfy this need many different commercial light arrays have been developed and sold within the last few years.

U.S. Patent describing decorative light arrays include:

| | |
|---|---|
| 1.640,282 | |
| 3,096,943 | 5,338,585 |
| 4,264,845 | 5,379,202 |
| 4,720,773 | 5,424,925 |
| 4,736,282 | 5,632,550 |
| 4,870,547 | 5,645,342 and |
| 5,213,519 | D-400,272. |

Generally, although not exclusively, the decorative light arrays are hung on the outside of buildings, wire frames, fences and outdoor trees. In this condition, the light arrays are subject to strong winds which cause the light arrays to tangle and otherwise disrupt the light array's pattern. This results in esthetically poor displays. A method is needed to prevent tangling and disruption of display patterns by strong winds.

SUMMARY OF THE INVENTION

The present invention provides a method for keeping light arrays in their desired pattern and free from entanglement even in high windstorms. This method is achieved by providing a decorative array of spaced apart multiple light bulbs mounted on spaced apart rows of two intertwined insulated electrical conductors electrically connected to each light bulb. Wire or tubing is strung between the intertwined insulated electrical conductors at a connection to a light bulb either at the end of a depending electrical conductor from a top row of conductors or at right angles to a depending electrical conductor.

BRIEF DESCRIPTION OF THE DRAWINGS

This invention will be more clearly understood from the following description, considered in conjunction with the accompanying drawings.

DETAILED DESCRIPTION OF THE INVENTION

Figure 1:
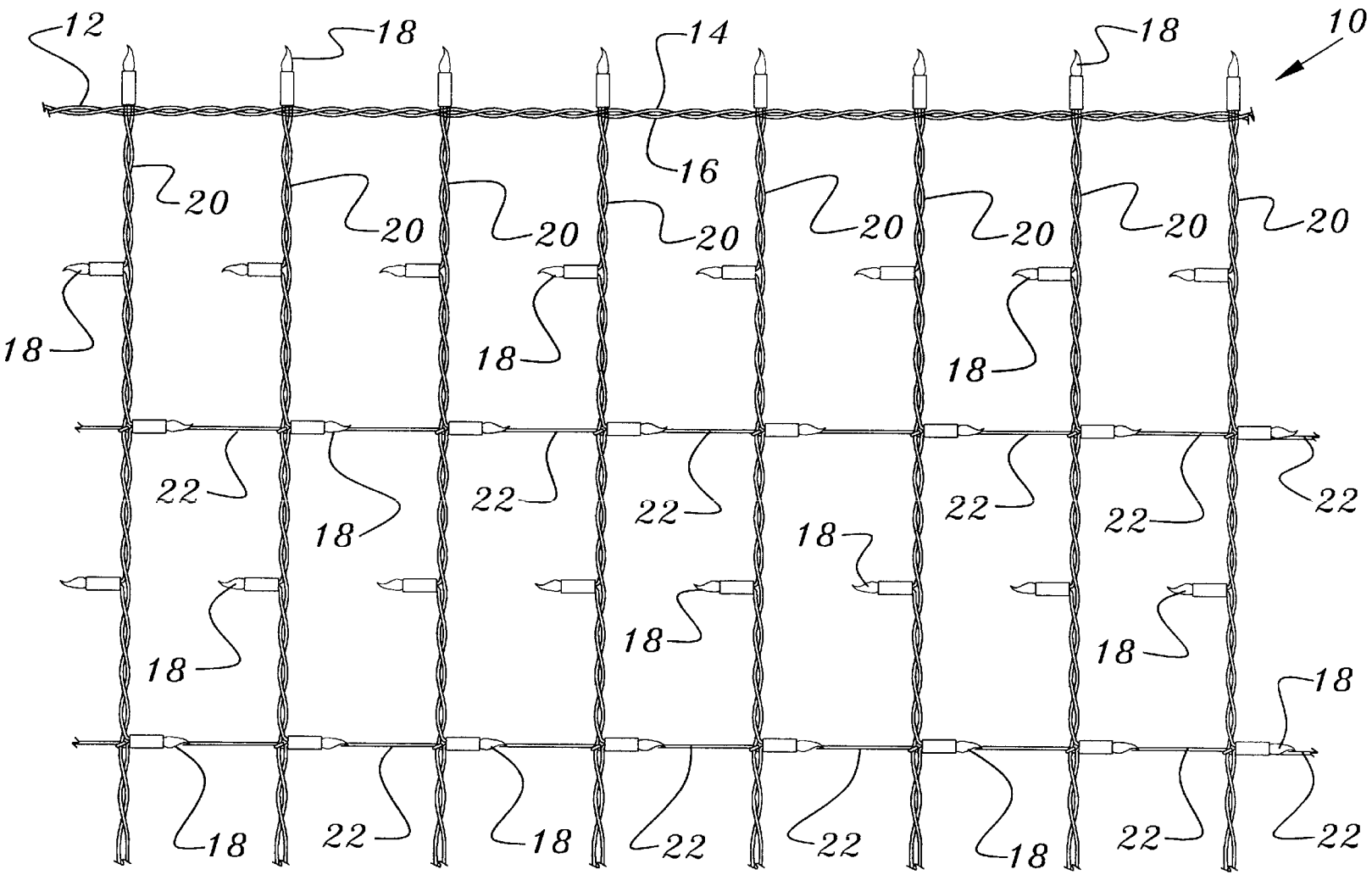
FIG. 1 is a front view of a portion of a light array supported according to the method of this invention.

Throughout the following detailed description, the same reference numerals refer to the same elements in all figures.

Referring to FIG. 1, an array 10 of an electrical light pattern has a top row 12 of an insulated electrical conductor 14 and 16 intertwined together. The conductors are electrically engaged to a plurality of lights 18. Depending downwardly from the top row 12 of intertwined electrical conductors 14 and 16 is a series of multiple downwardly depending intertwined electrical conductors 20. These insulated conductor rows 20 also have lights 18 electrically connected to the insulated conductors. A wire or tubing 22 is threaded through the intertwined conductors at the point of intersection with a light bulb 18 so that the downwardly depending rows 20 are kept spaced apart and prevented from being lifted by wind. The wire or tubular material 22 can be a metal such as iron or a lead alloy, or a high density plastic, at least 1 mm in diameter and if a metal preferably coated with a polymer.

Figure 2:
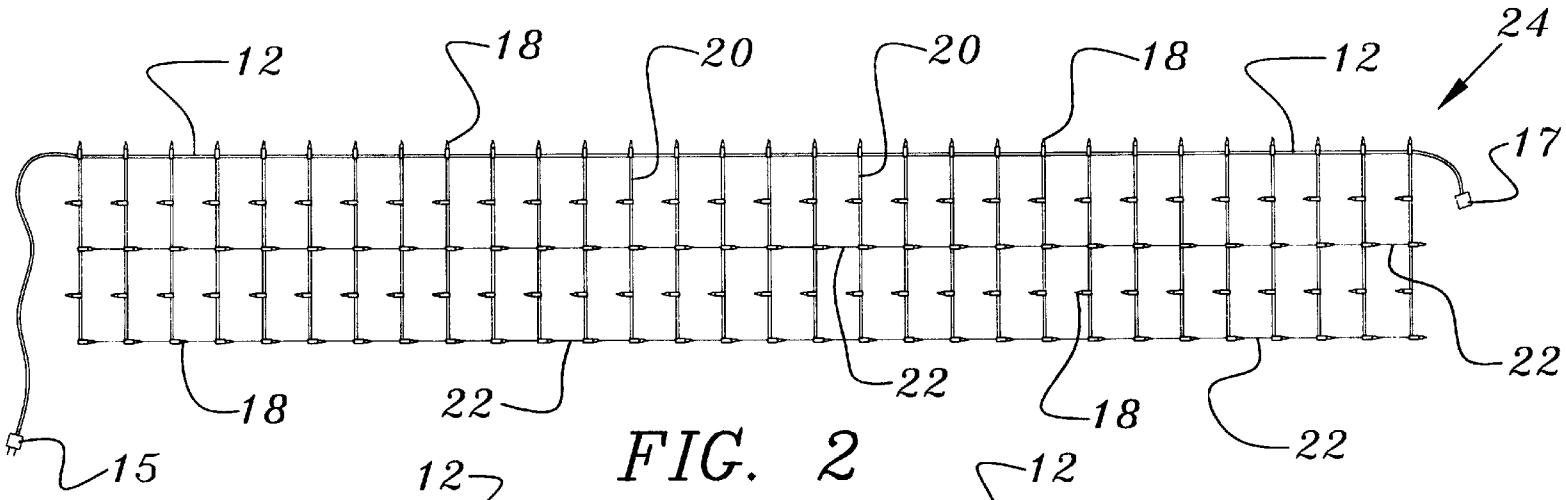
FIG. 2 is a front view of one light array pattern supported according to the method of this invention.

The lighting array 10 can have various patterns as shown through FIGS. 2–8. FIG. 2 shows a rectangular array 24. This array also has the intertwined lines 14 and 16 comprising a top row 12 with a downwardly depending intertwined rows 20. The wire or tubing 22 is strung parallel to the top row 12 and is threaded through the intertwined conductors to provide weight and stability to prevent entanglement. It is preferred that this rectangular array have a dimension of approximately 10 feet long by one foot wide and in such an array approximately 150 light bulbs constitute a total count. The bulb colors can be clear or multi-colored. In another embodiment, the array 24 can be as long as 20 feet with a one foot wide dimension and have a light bulb count of 300. These bulbs can also be either clear or multi-colored.

In all of the arrays, a male light plug 15 connectable to an electrical supply is electrically attached to one end of the top row 12 of intertwined electrical conductors 14 and 16 and a female plug 17 electrically terminates another end of the top row 12.

Figure 3:
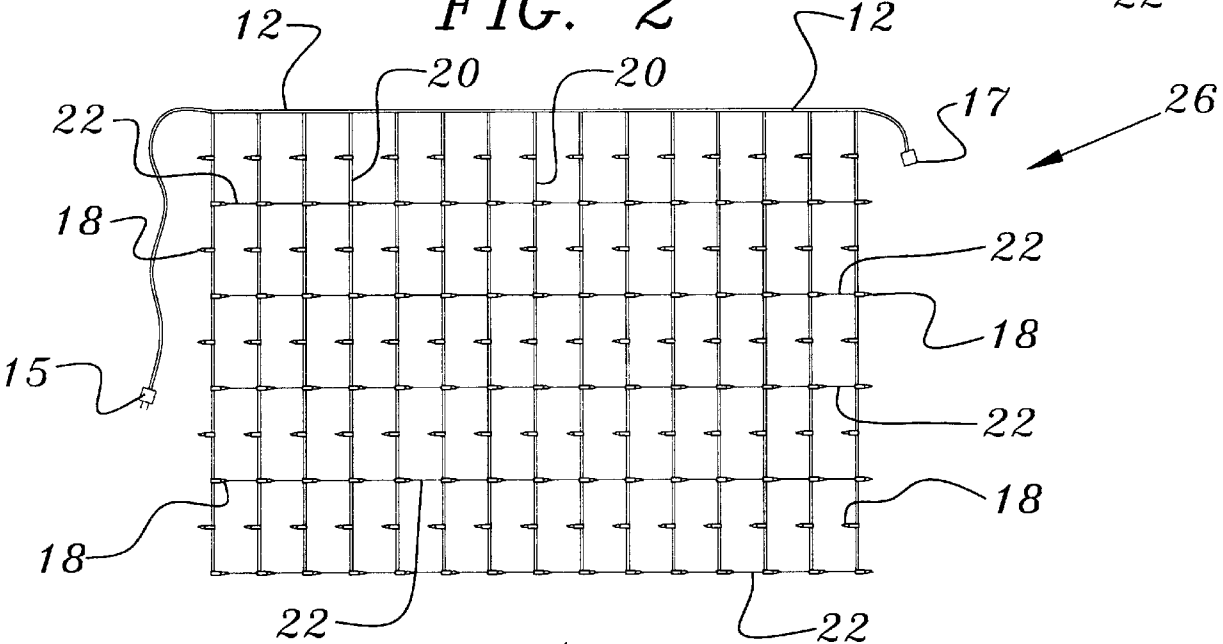
FIG. 3 is a front view of a second light array pattern supported according to the method of this invention.

Another array 26 is seen in FIG. 3 in which the light array takes the form of a blanket. As in the proceeding FIGS., the top row 12 contains the intertwined wires 14 and 16 and downwardly depending rows 20 also contain the two intertwined electrical conductors. As in a previous array, the lights 18 are electrically connected to the conductors both in row 12 and in rows 20. The wire 22 is threaded through the base of the light bulbs and through the intertwined electrical conductors spaced apart from one another and descending downwardly parallel to the top row 12. In FIG. 3, there are five rows of the wire or tubing 22. In the blanket array, the top long side can be anywhere from five to ten feet and the shorter downward side will be about 4 feet. In a 5 foot long array, there would be approximately 150 light bulbs and in the 10 foot array, there are approximately 300 light bulbs. These bulbs also can be clear or multi-colored.

Figure 4:
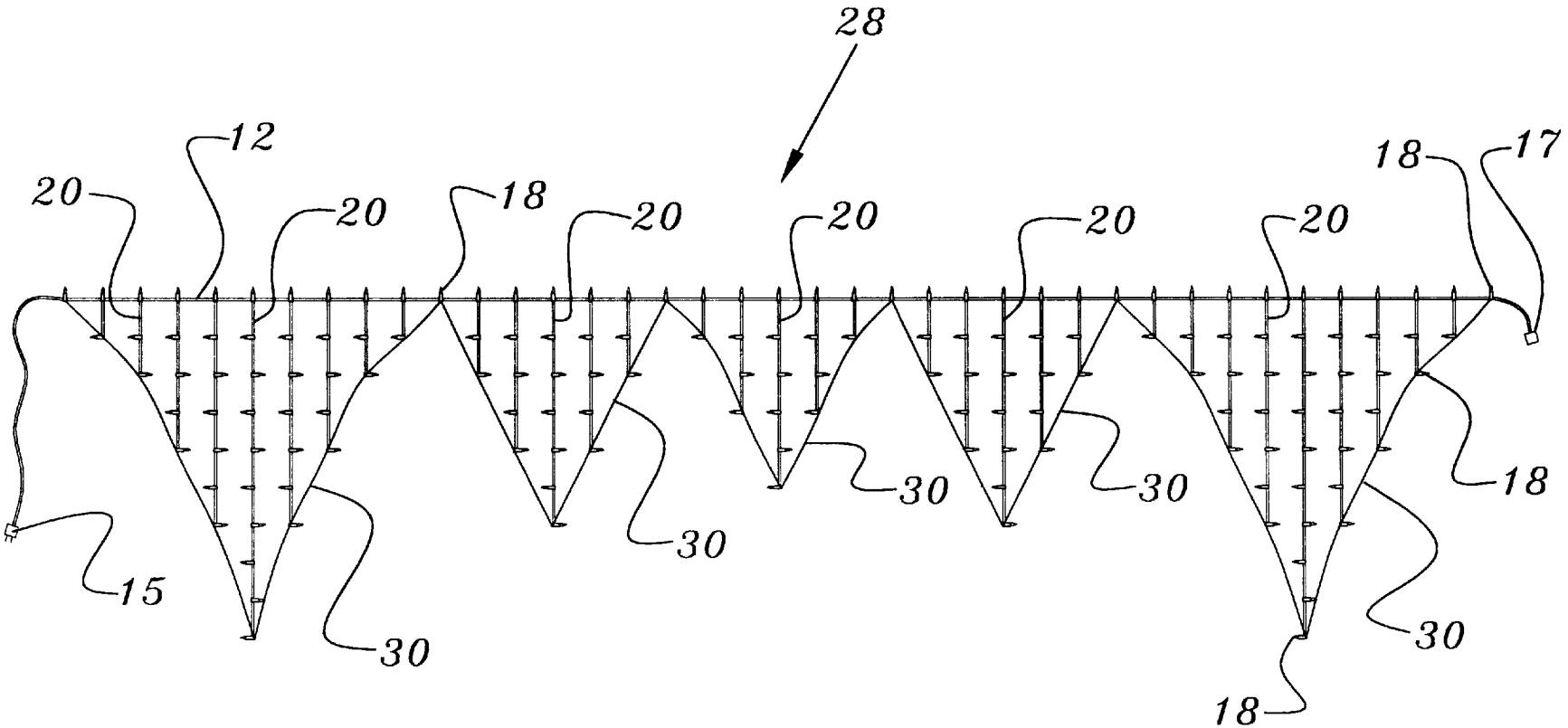
FIG. 4 is a front view of a third light array pattern supported according to the method of this invention.

FIG. 4 shows an icicle array 28 and has the same top row 12 of intertwined electrical conductors 14 and 16 with lights 18 electrically connected to the top row of conductors together with a series of depending parallel rows of intertwined electrical conductors 20. In this case, the depth of the descending electrical conductors 20 varies in order to give the pattern shown in FIG. 4. In this array, the wire or tubing 30 is threaded through the termination point of each downwardly descending pair of twisted electrical conductors 20 and through the base of a light bulb at the lowest point for each of the electrical conductors 20 so that an array 28 is created as shown in FIG. 4.

The icicle array 28 shown in FIG. 4 can have a top row 12 that is 10 to 20 feet long and 2 to 6 feet wide. In the 10 foot long array, the light count is approximately 150 and in the 20 foot array, the light count is approximately 300.

Figure 5:
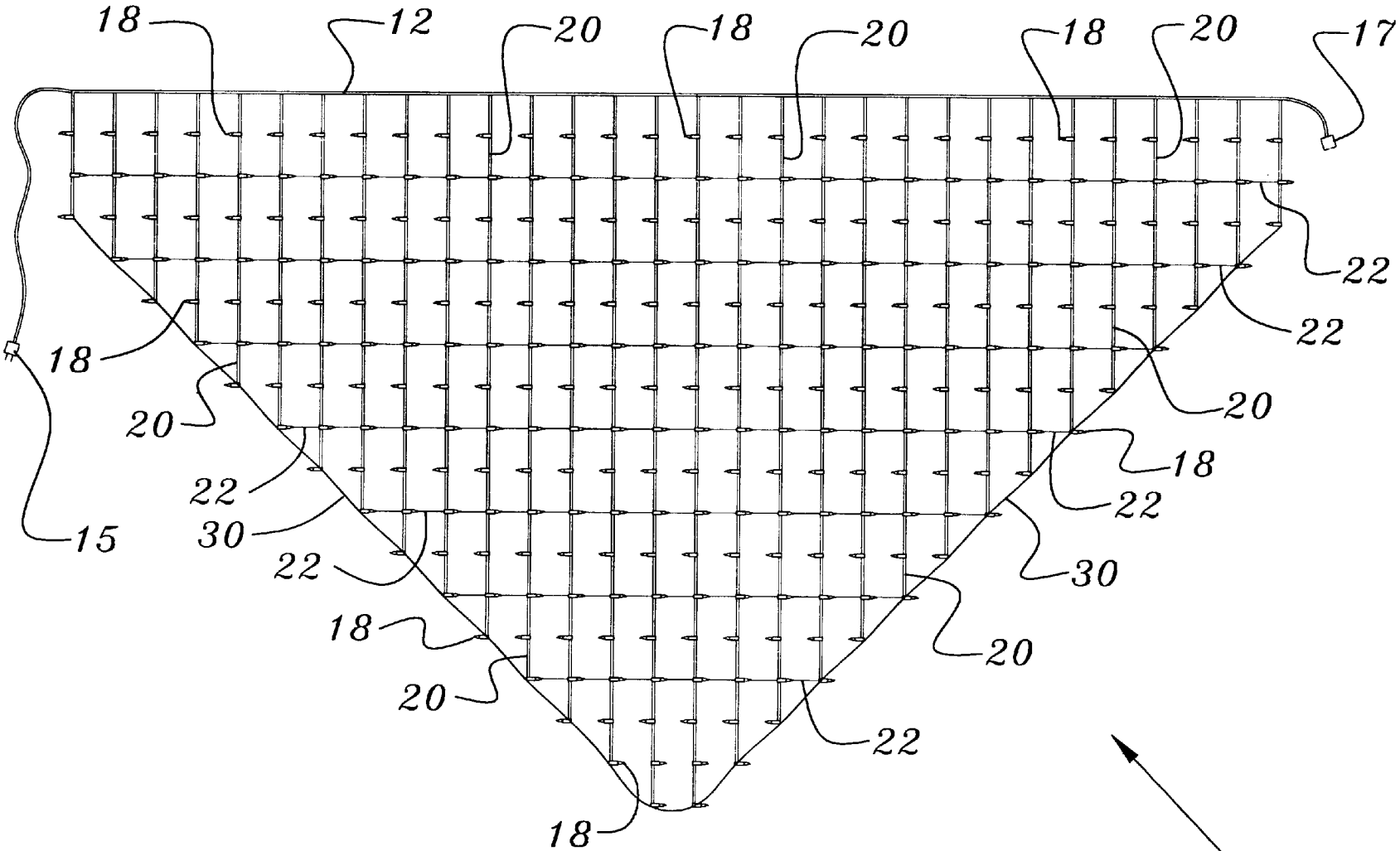
FIG. 5 is a front view of a fourth light array pattern supported according to the method of this invention.

Another array 32 is seen in FIG. 5. In this array, the top row 12 is electrically attached at one end 15 to the male connector and at the other end 17 to the female connector. There are multiple downwardly depending electrical conductors 20 that terminate at a different depth going downwardly and form the shape of a cone. As in the icicle array 28, a wire or tubular metal material 30 is threaded through to the terminal end of the intertwined electrical conductors 20 at the base of a light 18 so that the metal 30 outlines the edges of the array 32. Seven rows of wire or tubular material 22 as seen in previous arrays are attached parallel to the top intertwined electrical conductors 12. In the cone light array 32, the top row 12 is approximately 12 feet long and the depth of the cone light is 7 feet. In this configuration, there are approximately 300 lights either clear or multi-colored.

Figure 6:
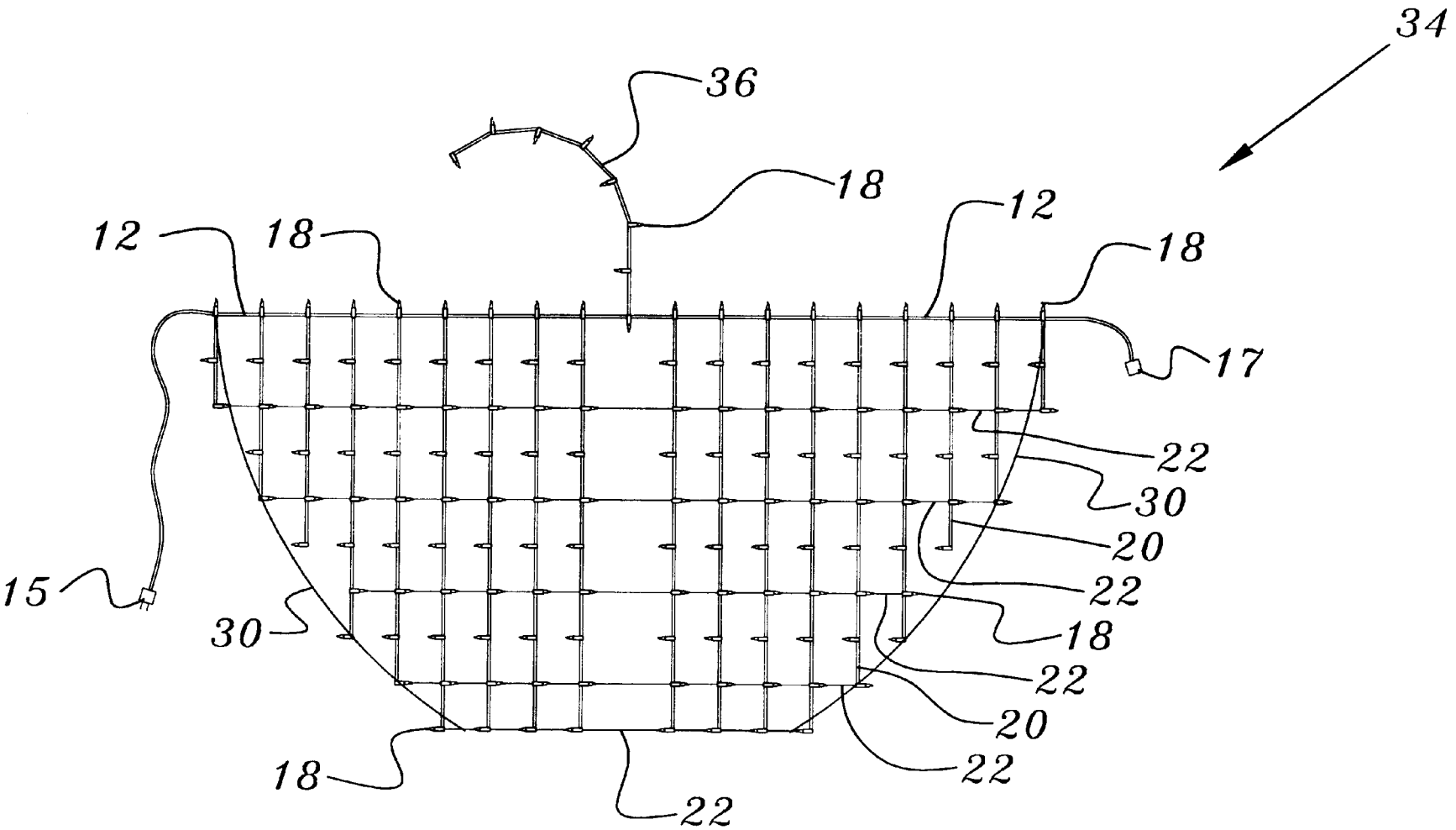
FIG. 6 is a front view of a fifth light array pattern supported according to the method of this invention.

Another array in the shape of a pumpkin 34 is shown in FIG. 6. There is the same male terminal 15 and female terminal 17 attached to the top row 12 and there are descending rows of intertwined electrical conductors 20 attached electrically to lights 18. On the periphery there is a wire or tubular material 30 which is intertwined at the base of lights and between the electrical conductors to form an outside pattern in the shape of a pumpkin. Parallel lines of wire or tubular material 22 as in previous arrays descend from the top row 12. In this case, there are 5 different rows of metal or tubular material 22. In addition there is an extra line 36 of intertwined electrical conductors with lights added as a top design to the pumpkin shape. In this configuration, the top row 12 is approximately 6 feet long and the longest row of intertwined electrical conductors 20 is 3 feet deep. There are approximately 150 lights and the bulb colors are usually iridescent, orange or green.

Figure 7:
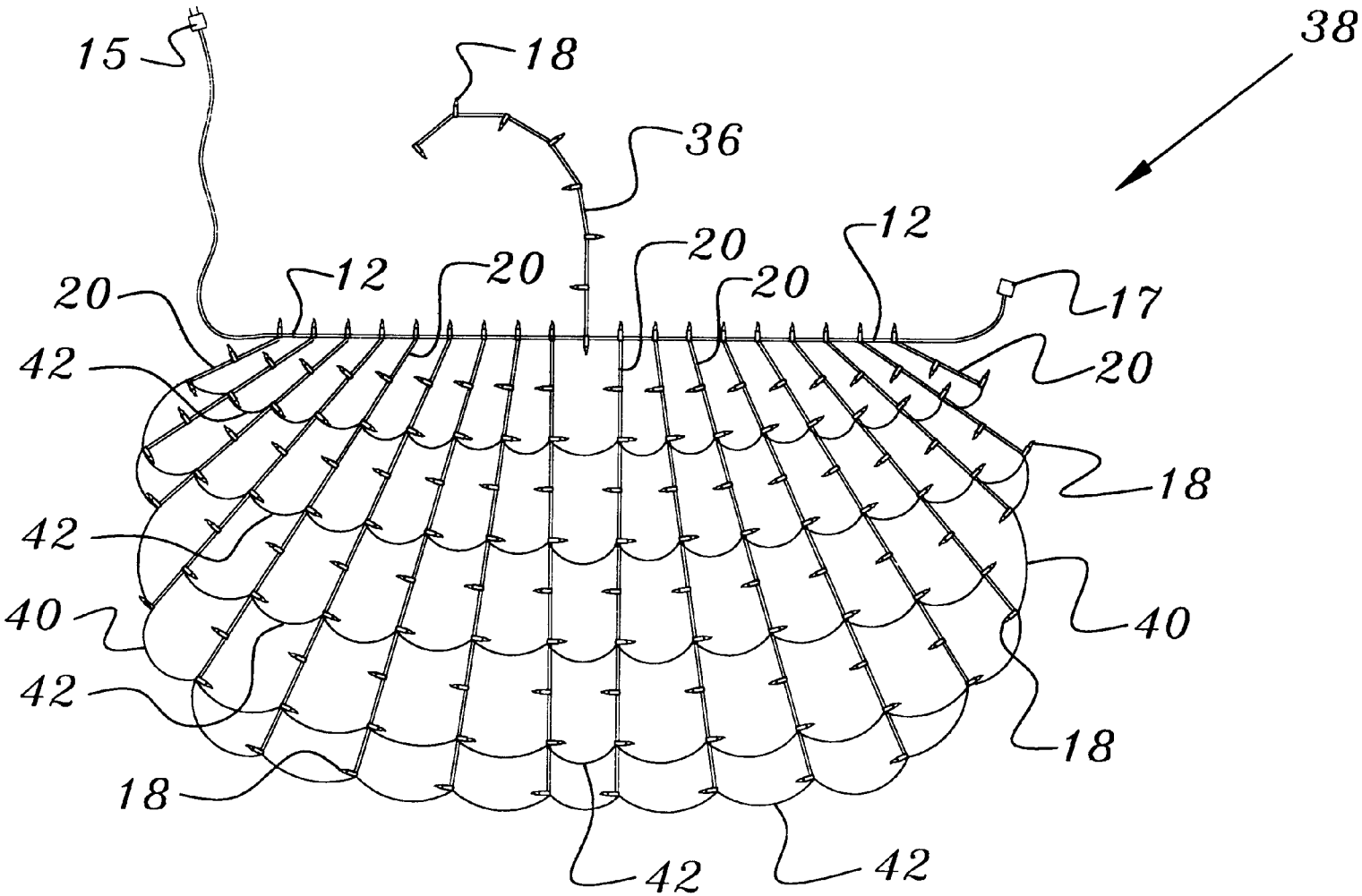
FIG. 7 is a front view of a sixth light array pattern supported according to the method of this invention.

FIG. 7 shows a spider web type light array 38 having a top row of intertwined electrical conductors 12 attached to lights 18 and at one end connected to a male plug 15 and at the other end to a female plug 17. A top line 36 is electrically connected to the top row 12 to add an attractive feature to the array. In this case, the depending rows of intertwined electrical conductors 20 electrically attached to bulbs 18 form a fan-type array downwardly and outwardly. This array is kept in place by wire or tubular material 40 that is threaded through the base of each terminal lightbulb and the terminal point of each downwardly depending intertwined electrical conductor 20. In addition, five rows of loops of wire or tubular material 42 are threaded through the downwardly depending electrical conductors 20 to prevent entanglement of the various electrical conductors. In this array, the top line 12 is about 6 feet long and the downward dimension is approximately 3 feet. In this array, the light count is about 150 of iridescent or clear bulbs.

Figure 8:
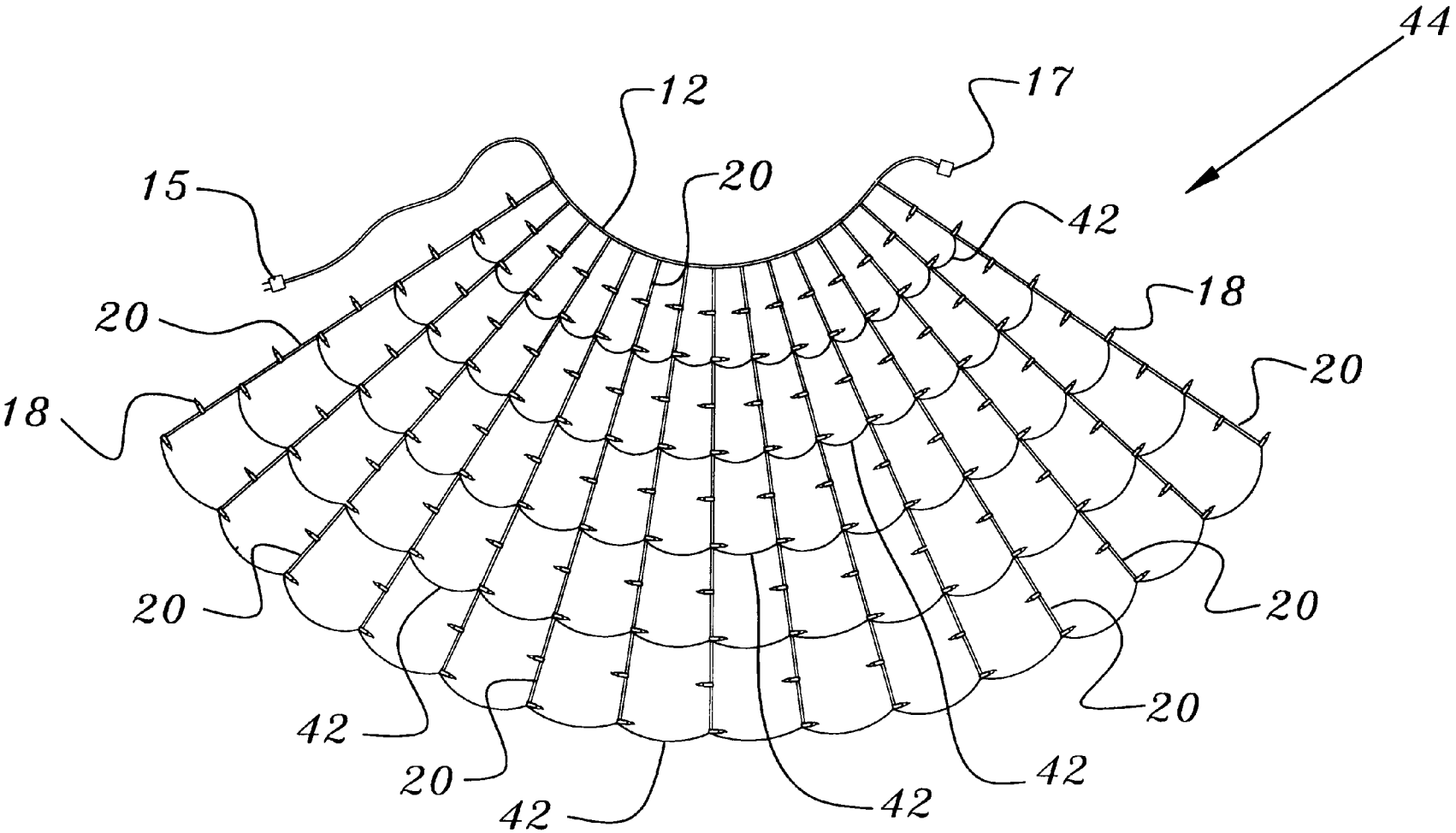
FIG. 8 is a front view of a seventh light array pattern supported according to the method of this invention.

Lastly, another spider web-type array 44 is shown in FIG. 8 where there is a top row 12 attached at one end to a male conductor 15 and at the other end to a female connector 17 and there are depending intertwined electrical conductors 20 attached to light bulbs 18. Loops 42 are threaded through the intertwined electrical conductors and through the base of the bulbs in five rows spaced from the top row 12. In this array, the top row 12 is about 6 feet long and the lowest dimension is about 3 feet deep with a light count of about 150 of iridescent or clear bulbs.

In use, the top row of an array is hung on the edge of a house roof line, an outdoor wire frame structure, fence, tree, bushes or other structure strong enough to support the weight of the array.

Other light arrays can be substituted for the light arrays set forth herein employing the same method of construction in order to achieve like results.

Having thus described the invention what is claimed and desired to be secured by Letters Patent is:

1. A method for supporting a decorative light array from entanglement comprising:

(a) providing a decorative array of spaced apart multiple light bulbs mounted on spaced apart rows of two intertwined electrical conductors, electrically connected to each light bulb;

(b) stringing a wire or tubing having a diameter of at least one millimeter between the intertwined insulated electrical conductors at a point of connection to a designated number of light bulbs in a continuous selected pattern; and (c) supporting the decorative array on a structure engaging a top portion of the decorative array with the wire or tubing depending below the structure.

2. The method according to claim 1 wherein the wire is disposed in the light array in parallel spaced apart rows at right angles to vertical rows of the two intertwined insulated electrical conductors depending downwardly from a top row of two intertwined insulated electrical conductors.

3. The method according to claim 1 wherein a tube is disposed in the light array in parallel spaced apart rows at right angles to vertical rows of the two intertwined insulated electrical conductors depending downwardly from a top row of two intertwined insulated electrical conductors.

4. The method according to claim 1 wherein the decorative array is provided in a rectangular shape with two intertwined insulated electrical conductors providing a top row and a pair of spaced apart parallel wire or tubing is strung between the intertwined insulated electrical conductors depending downwardly from the top row.

5. The method according to claim 4 wherein the rectangular shape is extended over a long side 10 to 20 feet and over a short side one foot with a light bulb count of 150–300.

6. The method according to claim 1 wherein the decorative array is provided in the shape of a blanket with a top long side and a depending short side with two intertwined insulated electrical conductors providing a top row on the long side and multiple parallel wire or tubing is strung between multiple parallel intertwined insulated electrical conductors depending downwardly from the top row.

7. The method according to claim 6 wherein the blanket array provides a top and bottom long side from 5 to 10 feet and a short side of 4 feet, with a light bulb count of 150–300.

8. The method according to claim 1 wherein the decorative array is provided in the pattern of icicles with two intertwined insulated electrical conductors providing a top row and a continuous wire or tubing is strung between an end of multiple parallel intertwined insulated electrical conductors depending downwardly from the top row.

9. The method according to claim 8 wherein the icicle array top row is extended a length of 10 to 20 feet and the downwardly depending electrical conductors are extended a length of 2 to 6 feet from the top row.

10. The method according to claim 1 wherein the decorative array is provided in the shape of a cone with two intertwined insulated electrical conductors providing a top row and a continuous wire or tubing is strung between an end of multiple parallel intertwined insulated electrical conductors depending downwardly from the top row.

11. The method according to claim 10 wherein the cone array top row is extended a length of 12 feet and the downwardly depending electrical conductors are extended a length up to 7 feet from the top row.

12. The method according to claim 1 wherein the decorative array is provided in the shape of a pumpkin with two intertwined insulated electrical conductors providing a top row, a continuous wire or tubing is strung between selected ends of multiple parallel intertwined insulated electrical conductors depending downwardly from the top row and multiple parallel spaced apart rows of metal wire or tubing is strung at right angles between the intertwined insulated electrical conductors depending downwardly from the top row.

13. The method according to claim 12 wherein the pumpkin array top row is extended a length of about 6 feet and the downwardly dependent electrical conductors are extended a length up to about 3 feet from the top row.

14. The method according to claim 1 wherein the decorative array is provided in the shape of a spider web with two intertwined insulated electrical conductors providing a curved top row aid multiple spaced apart rows of wire or tubing is strung between multiple intertwined insulated electrical conductors depending downwardly and outwardly from the top row.

15. The method according to claim 14 wherein the spider web array top row is extended a length of about 6 feet and the downwardly dependent electrical conductors are extended a length up to about 3 feet from the top row.

* * * * *